US005255923A

United States Patent [19]

Bennett

[11] Patent Number: 5,255,923

[45] Date of Patent: Oct. 26, 1993

[54] BOARD GAMES

[75] Inventor: Paul F. Bennett, Altrincham, England

[73] Assignee: Waddingtons Games Limited, Leeds, England

[21] Appl. No.: 768,879

[22] PCT Filed: Jan. 4, 1990

[86] PCT No.: PCT/GB90/00011

§ 371 Date: Oct. 24, 1991

§ 102(e) Date: Oct. 24, 1991

[87] PCT Pub. No.: WO90/15650

PCT Pub. Date: Dec. 27, 1990

[30] Foreign Application Priority Data

Jun. 16, 1989 [GB] United Kingdom ..... 8913942

[51] Int. Cl.[5] ..... A63F 3/00

[52] U.S. Cl. ..... 273/284; 273/285; 273/287

[58] Field of Search ..... 273/285, 286, 287, 284, 273/441–443; 281/2, 5; 283/62

[56] References Cited

U.S. PATENT DOCUMENTS

| | | | |
|---|---|---|---|
| 3,057,624 | 10/1962 | Bassett | 273/283 |
| 3,487,573 | 1/1970 | Slovacek | 283/62 |
| 3,601,401 | 8/1971 | Beck | 273/283 |
| 3,758,693 | 9/1973 | Ebert | 273/443 |
| 4,365,438 | 12/1982 | Nelson | 273/287 |

FOREIGN PATENT DOCUMENTS

| | | | |
|---|---|---|---|
| 591120 | 8/1947 | United Kingdom | 273/282 |

*Primary Examiner*—Benjamin H. Layno
*Attorney, Agent, or Firm*—Klauber & Jackson

[57] ABSTRACT

The invention relates to a board game typically including counters, playing pieces, pawns or the like. The playing pieces are placed of the board and moved across the board in accordance with the play of the game wherein the game board is comprised of at least two sections, one of which has an aperture. The sections are arranged to be part of a game where during the course of play a player or players move pieces on a first section of the board in a direction which may lead to the aperture so that the piece rests on a second section of the playing board and the first section can be moved clear of the second section in order to reveal a second board on which play can take place in the subsequent playing of the game.

10 Claims, 1 Drawing Sheet

BOARD GAMES

This invention relates to board games, and in particular concerns an improvement in game boards which are used in such games.

BACKGROUND OF THE INVENTION

Typically, a board game will include a board upon which play takes place. The board, in order to fit into the box may typically be a single thick sheet of cardboard or the like material folded in two, and which is opened for the play of the game.

Usually, a board game will include counters, playing pieces, pawns or the like which are placed on the board, and are moved across the board in accordance with the play of the game. Board games constructed in the above fashion have been known for very many years, and largely still continue in use today.

SUMMARY OF THE INVENTION

The present invention seeks to provide a novel form of game board enabling the extension of play on a board to enhance a wide range of board games.

In accordance with the invention, a game board for a game board has at least two sections, one of which has an aperture or cut-out and said sections being arranged to be part of a game wherein in the play of the game a player or players move playing pieces on a first play surface on the first section of the board and on which play does or may lead the one or one of the players to place the or one of the playing pieces in the recess or aperture so that it rests on the second section of the playing board, and the first section can be moved clear of the second section in order to reveal a second section of playing board on which play can take place in the subsequent playing of the game.

It will be understood therefore, that the play area of the board is extended by the board being in several sections which will be located one above the other in one part of the play of the game, but the second section comes into play when a playing piece moves into the aperture or recess.

It may be that the play areas of the respective sections relate to different types of board game so that when a player moves a playing piece into an aperture or recess and the first section of the board is removed, he has to play another type of game on the second section of the playing board.

In one embodiment, the first section of the playing board has a circular aperture therein forming the means through which the playing piece or playing pieces pass when the first section is removed.

The first and second sections may be hinged together and may be defined in a common sheet of cardboard or the like material defining the playing board.

In yet a further and preferred embodiment, there are two folded sheets forming the playing board, the sheets being adapted for temporary connection, for example by jigsaw type coupling, and the respective first sections of each folded sheet can be folded clear of the second sections to reveal the second section playing surfaces. The playing surface when the second sections are in use may be defined jointly by said second sections.

It has been proposed that the free edges of the second sections should be capable of being joined temporarily, and the first sections are approximately the same size as the second sections but are hinged to the opposite sides from where the second sections are temporarily joined, said first sections being folded inwardly so that their free edges lie adjacent and above the join region between the second sections. The two first sections form a first playing surface and each has an aperture therein, and the player or players play on the first surface but when a playing piece is positioned in the aperture in either of said first sections, that first section is folded outwardly to define a second playing board or a portion thereof which is provided on the upper surface of the second section, and the undersurface of the first section. The second playing board in fact may be defined on all four sections on the upper surface of the two second sections and on the under surface of the two first sections.

By using as playing board of this form, many novel forms of board game can be devised, the movement of play between a first board play area and a second board play area enhancing the pleasure to be derived from the play of the game.

It is not necessary that the first sections be hinged to the second sections, and indeed there may be third and fourth sections, the upper sections being provided with apertures so that the play moves progressively from one section of board to another, by virtue of the playing piece passing through the cut-out or aperture, and the previously played board section being removed or moved in order to reveal an underboard section.

One embodiment of the invention will now be described, by way of example, with reference to the accompanying drawings, which are diagrammatic in nature, and wherein:

BRIEF DESCRIPTION OF THE PREFERRED EMBODIMENTS

Figure 1:
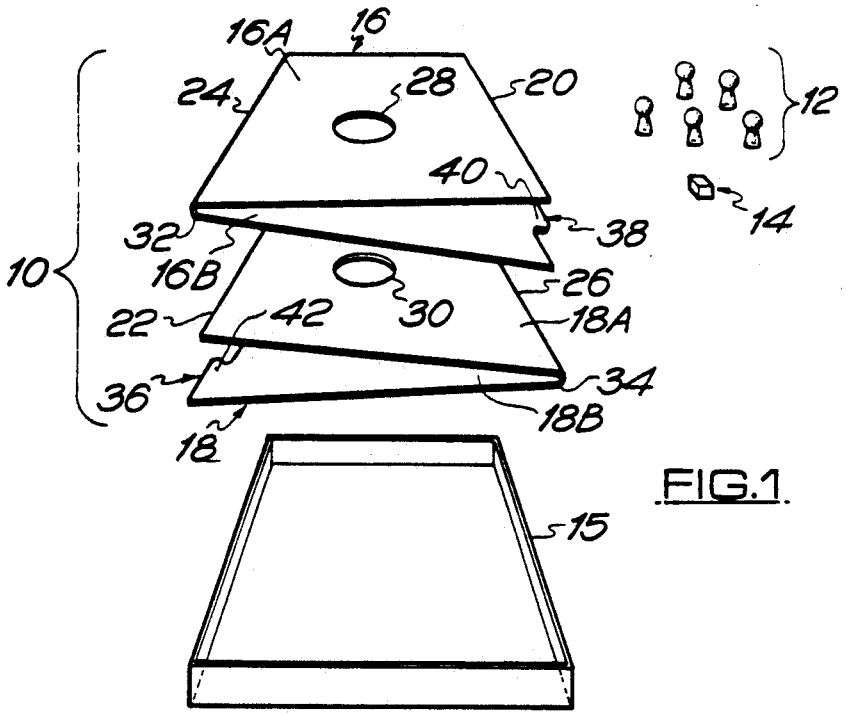
FIG. 1 is a perspective exploded view of a board game including a board, playing pieces and a dice, the view also indicating the box in which the game contacts are contained.

Referring to the drawings, a board game of which the particulars of play and the rules are not given herein, comprises basically a play board 10, playing pieces 12 and a dice 14. The game will of course have rules of play, and thee may be provided within the game contents as a separate leaflet or they may be printed on the box 15 which serves to hold the game contents.

The board 10 is in two parts 16 and 18, and each part 16, 18 comprises a sheet of thick cardboard or the like material which is folded in two to define two sections 16A, 16B and 18A, 18B which are rectangular and of approximately equal size, and are sized so as to fit into the box 15 neatly.

Of each board part 16, 18, the upper section 16A, 18A has a free edge 20, 22 and a fold edge 24, 26, and a central aperture 28, 30. The second section 16B, 18B of each board part 16, 18 has a fold edge 32, 34 connected to the first part fold edge 24, 26, and a free edge 36, 38 and along the free edge 36, 38 are formed jigsaw-like coupling ears 40, 42, and the ears 40 of the one part are complimentary to the ears 42 of the other part so that the two board parts 16, 18 can be temporarily coupled as shown most clearly in FIG. 4 for the play of the game.

Figure 2:
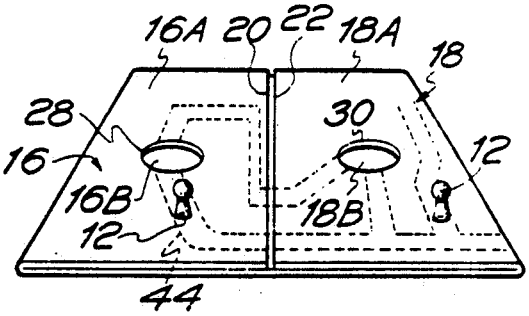
FIG. 2 shows the board of FIG. 1 when the parts are joined together and are ready for playing the game on the first sections of the board.
Figure 3:
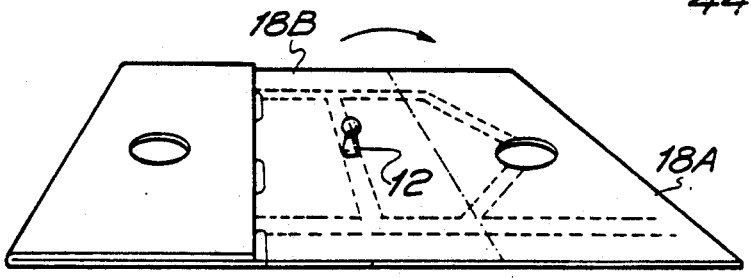
FIG. 3 shows the board of FIG. 2 when partially opened so that at least part of the play takes place on a second section of the board.
Figure 4:
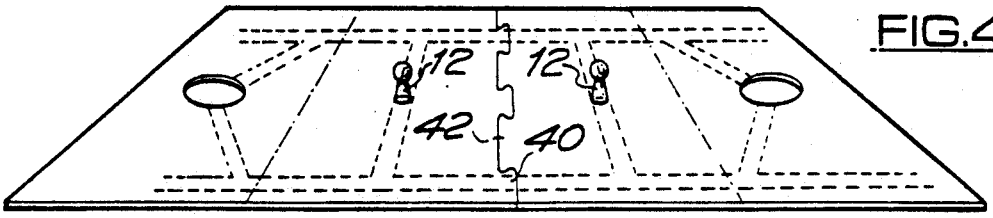
FIG. 4 shows the board in a fully opened condition, when play takes place on both second sections of the board.

Referring now to FIG. 2, the board 10 is used for the play of the game initially with the first sections 16A, 18A folded over the second sections so that the free edges 20, 22 of the first sections are adjacent, and the first sections 16A, 18A conceal the second sections 16B, 18B apart from what is visible through the apertures 28, 30. On the upper surfaces of the first sections is defined by suitable printing 44 or otherwise a play board area on which play takes place. Such play may typically involve the placement and movement of the pieces 12 on the first play board area. It is arranged that in the play of the game the or one of the play pieces 12 must or may move into the aperture 28, 30 so as to rest on the exposed upper surface of the appropriate second section 16B, 18B. When this happens, the appropriate second section 16, 18 of the board is hinged to the open position shown for example by the first section 18A in FIG. 3, and the playing piece 12 continues to rest on the upper surface of the second section 18B. Continued play of the game involves the moving of the piece on a second play board defined on the upper surface of the second section 18B. Similarly, when a piece is placed in the aperture 28 of the first section 16A during play of the game, the first section 16A is moved to the open position as shown in FIG. 4, and the now exposed upper surface of the second section is a play board. Play continues therefore on the second play board constituted by the two exposed second sections. In fact the total play board may be defined by the exposed upper surfaces of the second sections, and the now exposed under surfaces of the first sections so that an extended play board is exposed.

Instead of there being a single aperture in the upper section, there may be two or more apertures used for a similar function, or instead of an aperture a cut-out at an edge of the first section may be provided.

What is claimed is:

1. In a game comprising playing pieces and a game board having at least first and second board sections, defining first and second game sections, the first board section having an aperture or cut-out and said board sections being arranged to be part of a game wherein the first board section is superposed on the second board section and in the play of the game the player or players move playing pieces on the first game section on the first board section and on which play does or may lead the or one of the players to place the or one of the playing pieces in the aperture or cut-out so that it rests on the second board section, and the first board section can be moved clear of the second board section in order to reveal the second game section on which play can take place in the subsequent playing of the game, so that the portion of the second board section accessible through the aperture simultaneously forms part of both the first game section and the second game section, the improvement that the first board section comprises a reverse thereof, wherein at least part of the reverse of the first board section constitutes a part of, and extends, the second board section.

2. A game board according to claim 1 characterized in that the first and second play sections respectively relate to different types of board game so that when a player moves a playing piece into an aperture or cut-out and the first board section is removed, he has to play another type of game on the second board section.

3. A game board according to claims 1 or 2 characterized in that the first board section has a circular aperture therein forming the means through which the playing piece or playing pieces passes or pass when the first board section is removed.

4. A game board according to claim 1 characterized in that the first and second board sections are hinged together and are defined in a common sheet of cardboard or similar material defining the playing board.

5. A game board according to claim 1 characterized in that there are two folded sheets forming the playing board, the sheets being adapted for temporary connection, and the respective first board sections of each folded sheet can be folded clear of the second board sections to reveal the second game section.

6. A game board according to claim 5, characterized in that the second game section is defined jointly by the said second game sections.

7. A game board according to claim 5 or 6 characterized in that the free edges of the second board sections are capable of being joined temporarily, and the first board sections are approximately the same size as the second board sections but are connected to the opposite sides from where the second board sections are temporarily joined, said first board sections being folded inwardly so that their free edges lie adjacent and above the join region between the second board sections.

8. A game board according to claim 7, characterized in that the two first board sections form a first game section and each has an aperture therein, and the player or players play on the first game section but when a playing piece is positioned in the aperture in either of the first board sections, that first board section is folded outwardly and the second game section is provided on the second board section, and the reverse of the first board section.

9. A game board according to claim 8 characterized in that the second game section is defined on all four board sections these being the upper surface of the two second board sections and on the under surface of the two first board sections.

10. A game board according to claim 7 characterized in that the first board sections are hinged to the opposite sides from where the second board sections are temporarily joined.

* * * * *